US005964049A

United States Patent [19]

Dean et al.

[11] Patent Number: 5,964,049

[45] Date of Patent: Oct. 12, 1999

[54] TRENCHER

[75] Inventors: Patrick E. Dean, Lake Elmo; Jerry M. Anderson, Stillwater, both of Minn.

[73] Assignee: For the Edge, Inc., Lake Elmo, Minn.

[21] Appl. No.: 09/015,550

[22] Filed: Jan. 28, 1998

[51] Int. Cl.[6] ..... E02F 5/08

[52] U.S. Cl. ..... 37/189; 37/462; 172/120; 172/123

[58] Field of Search ..... 37/189, 462, 352, 37/347; 172/43, 120, 122, 123, 15, 13

[56] References Cited

U.S. PATENT DOCUMENTS

| | | | |
|---|---|---|---|
| 4,503,630 | 3/1985 | Riley . | |
| 5,101,583 | 4/1992 | Scordilis | 37/189 X |
| 5,199,195 | 4/1993 | Scordilis et al. | 37/189 X |
| 5,226,248 | 7/1993 | Pollard . | |
| 5,333,399 | 8/1994 | Mett | 37/189 X |
| 5,381,616 | 1/1995 | Disney | 37/189 X |

OTHER PUBLICATIONS

Brown Manufacturing, Trench Master brochure, Date Unknown.

T.H. Riley Manufacturing, Kwik Trench Brochure, Date Unknown.

*Primary Examiner*—Christopher J. Novosad

[57] ABSTRACT

A trencher has an adjustable depth arbor support mechanism. The depth control mechanism includes a linkage which normally controls the depth of the trench being dug, but which also will allow the arbor to retract from the ground if it hits an obstacle. Preferably, the arbor support mechanism is at least partially counterbalanced by a spring, to allow the arbor to retract without undo force. The trencher has two wheels equidistant on either side of the arbor, and a third steerable wheel at the front of the trencher in line with the arbor. The cutting teeth are mounted to the arbor using a variety of chucks and mounting brackets, so the width of the trench is adjusted by adjusting the chucks and mounting brackets used.

17 Claims, 4 Drawing Sheets

TRENCHER

BACKGROUND OF THE INVENTION

1. Field of the Invention

The invention relates to digging equipment, and in particular, to equipment for trenching.

2. Description of the Related Art

Trenchers are used in landscaping to define beds, dig ditches for the bases of walls, allow insertion of edging and the like. Trenchers also are used by electricians and utilities to install cables or wiring in small trenches in the ground.

The trenchers available in the past, such as those shown in U.S. Pat. Nos. 4,503,630 and 5,226,248 have several common problems. First, the blades for the systems are off-center from the wheels. This creates a potential imbalance in the system, which can be particularly troublesome on hills. This problem is largely caused because the prior art systems are steered from the back, and the steering wheel cannot be directly behind the arbor, because that is where the trench is. Second, the blades, while adjustable in height, are fixed once adjusted. No provision is made to allow retraction if the blades hit an obstruction in the ground, such as a large rock. This means the user must constantly be on guard against such a possibility to avoid damaging the machine, and must manually move past or around the obstacle. Last, all of the currently available systems lift dirt out of the trench and deposit it immediately adjacent to the trench. From this location, dirt frequently is knocked or falls back into the trench.

SUMMARY OF THE INVENTION

The present invention provides a new trencher in which the blades are centered relative to the support wheels. Centering of the blade is accomplished by using a tripod wheel structure with a steerable wheel at centered at the front of the trencher and the blade centered between the two rear wheels. Placing the steerable center wheel at the front of the trencher instead of at the back) allows the wheel to roll right down the line on which the trench is to be dug. This both makes steering easier, and avoids having the wheel off-center. In addition, having the blade between the two rear wheels allows smoother turns.

A further aspect of the present invention provides a mechanism to retract the arbor out of the ground in the event it hits a large obstruction. The arbor is allowed to retract from the ground in the event it hits an obstacle by supporting it on a pivoted arm and controlling its depth with a sliding linkage and a spring. The linkage allows the arbor to lift upwards in the event an obstacle is hit, while the spring serves as a counterbalance to ensure that excessive force is not required to lift the arbor. The weight of the arbor and the support mechanism, as well as the biting action of the trencher teeth, normally will pull the arbor down into the dirt. However, if an obstacle is hit, the blade will not be able to get through, and will lift up as it works its way past the obstacle.

A still further aspect of the invention is to automatically lift the dirt and deposit it some distance from the trench, so that the dirt will not fall back into the trench. This also has the advantage of allowing placement of the dirt on a trap or into a wagon to allow easy clean-up, if desired. The ability to shift dirt well to the side of the trench is provided by having the arbor and teeth lift the dirt up into a vertical housing. As the dirt moves upward, it moves into a deflector, which directs the dirt well to the side of the trench.

Preferably, the deflector is reversible, so that the dirt can be shifted to either side of the trencher.

DETAILED DESCRIPTION OF THE PREFERRED EMBODIMENTS

Figure 1:
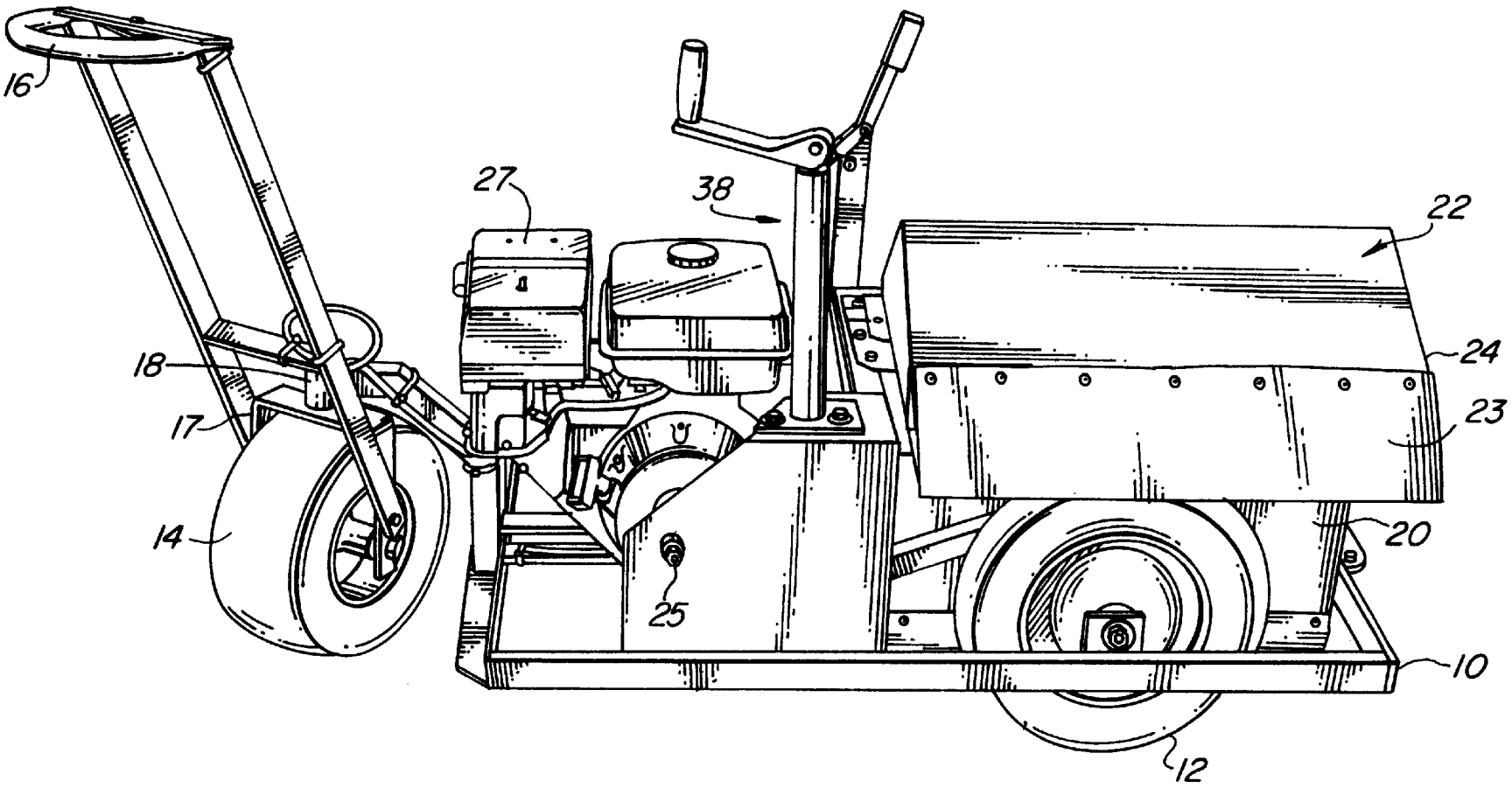
FIG. 1 is a perspective view of a trencher according to the present invention.
Figure 2:
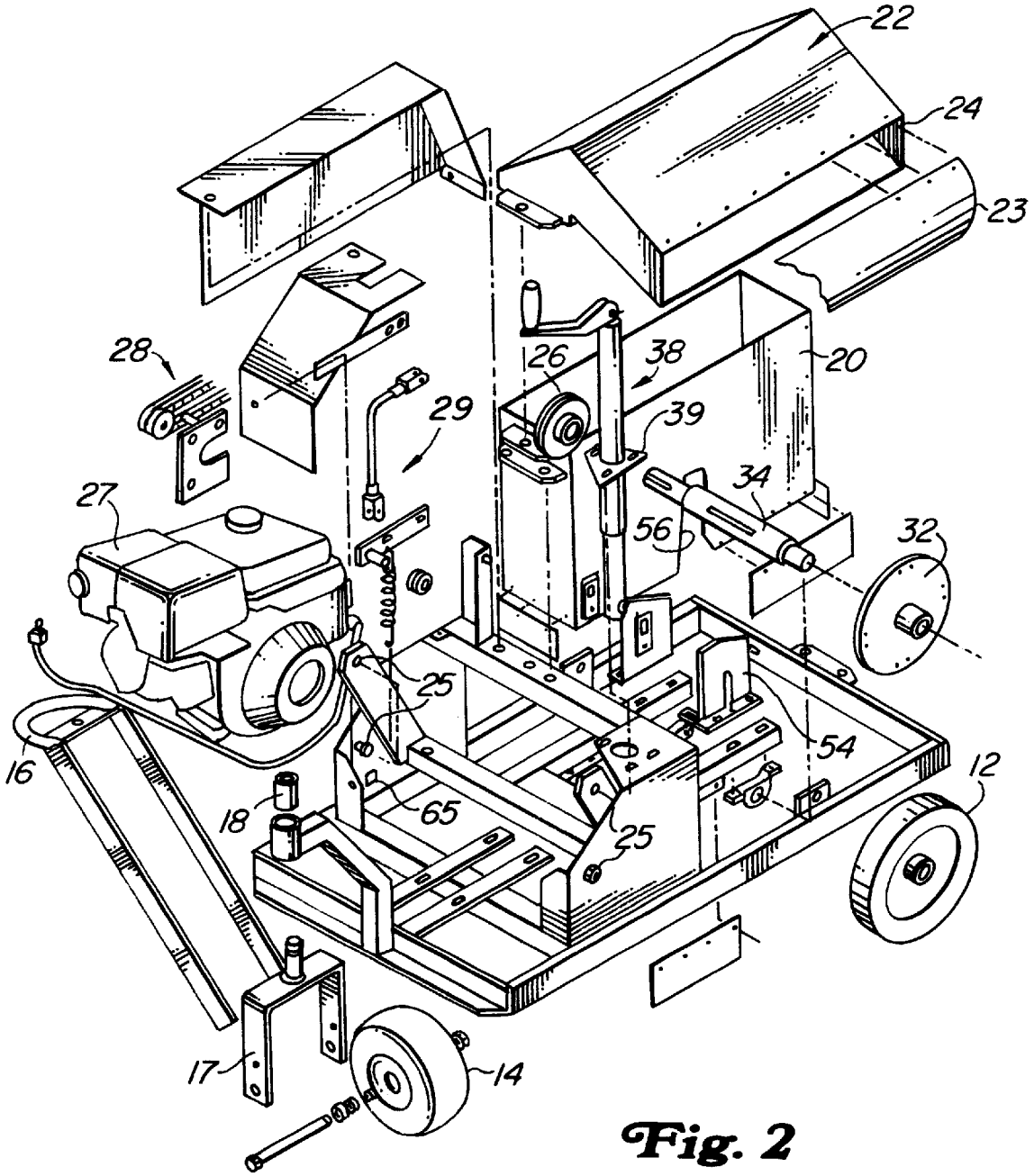
FIG. 2 is an exploded isometric view of the trencher of FIG. 1.

As best seen in FIGS. 1 and 2, a main frame 10 has two rear wheels 12 rotatably mounted thereto (only the foreground wheel is visible for clarity of illustration). A front wheel 14 and steering handle 16 are mounted to a front wheel bracket 17, which is in turn rotatably mounted to the main frame 10 via bushing 18. The bushing 18 is located along the longitudinal center line of the main frame 10, so that the rear wheels 12 and front wheel 14 form a balanced tripod arrangement which is readily steerable by changing the direction of the steering handle 16.

An arbor housing 20 is mounted on the main frame 10 towards the rear thereof and centered between the rear wheels 12. A deflector housing 22 is removably attached to the top of the arbor housing 20, and preferably is reversible to deflect dirt in either direction. A rubber flap 23 or the like preferably is provided on the discharge chute 24 of the deflector housing 22 to prevent objects from being thrown.

An arbor pivot bracket 30, which will described more fully below, is pivotally mounted to the main frame 10 at pivot points 25, e.g., by the use of bolts or pins. An arbor 32 is fixedly mounted to a shaft 34 which is rotatably mounted to the arbor pivot frame 30. A pulley 26 is fixed to the shaft 34. An engine 27 is mounted to the main frame 10, and drives the shaft 34 and arbor 32 through a belt drive 28 and clutch 29 to the pulley 26 in the usual manner.

Figure 3:
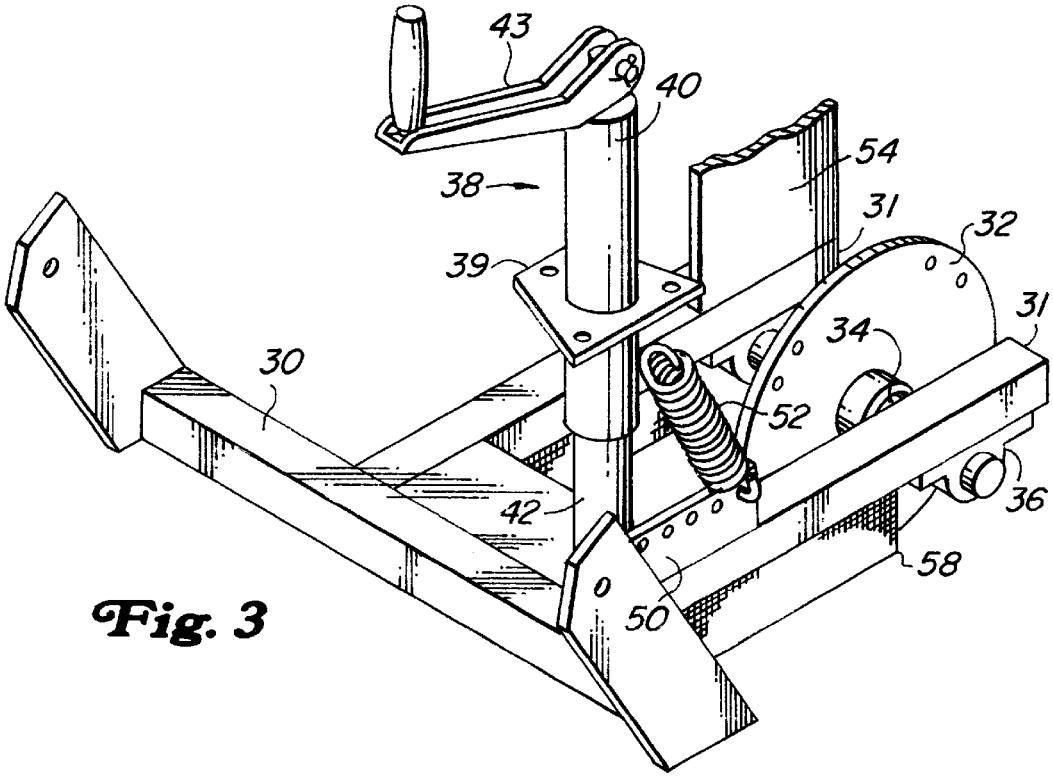
FIG. 3 is an isometric view of the arbor support mechanism of the trencher of FIG. 1.

Turning to FIG. 3, the arbor support mechanism is shown in more detail. The arbor pivot frame 30 has two arms 31 which extend symmetrically on either side of the longitudinal axis of the trencher. The arbor 32 is fixedly mounted to the shaft 34, which is rotatably mounted by pillow block bearings 36 to the underside of the arms 31.

The position of the pivot frame 30, and consequently of the arbor 32, in the vertical direction is generally controlled by a telescoping shaft 38. The telescoping shaft 38 is mounted to the main frame 10 by a mounting bracket 39 (as best seen in FIG. 2). The mounting bracket 39 is mounted to the upper shaft 40 of the telescoping shaft 38, so the upper shaft 40 is fixed relative to the main frame 10, while the lower shaft 42 of the telescoping shaft 38 can move up an down. The relative positions of the upper shaft 40 and lower shaft 42 are controlled by an internal screw through rotation of the handle 43.

Figure 4:
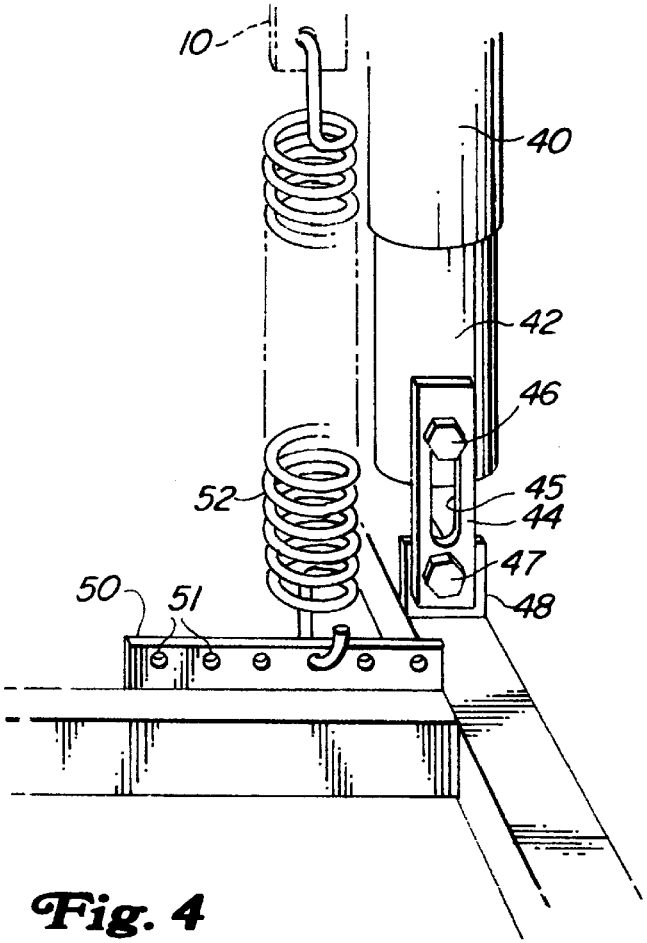
FIG. 4 is a detail of the arbor support mechanism of FIG. 3.
Figure 5A:
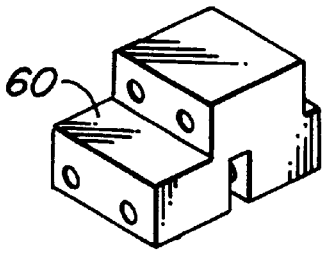
FIGS. 5*a*–5*f* are views of chucks, mounting brackets and points for the trencher.
Figure 5B:
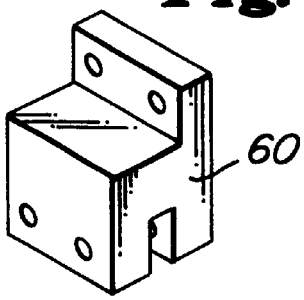
Figure 5C:
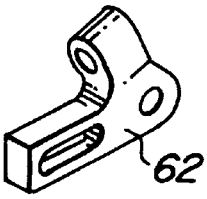
Figure 5D:
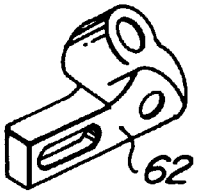
Figure 5E:
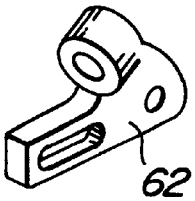
Figure 5F:
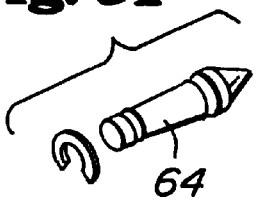

Turning to FIG. 4, the lower shaft 42 is connected to the arbor pivot frame 30 by a pair of depth control links 44 (only the foreground link is visible in the drawing—a similar link is provided on the other side of the lower shaft 42). Specifically, a bolt 46 is connected to the lower shaft 42 and a bolt 47 is connected to a bracket 48 mounted on the arbor pivot frame 30. The bolts 46, 47 extend through an opening 45 in each depth control link 44. As will be apparent, the weight of the arbor pivot frame 30 and the rest of the arbor mechanism normally will pull the links 44 downwards as far as allowed by the bolts 46, 47 within the opening 45. However, if something (such as an obstruction in the ground) forces the arbor pivot frame 30 upwards, the links 44 will allow such movement up to the point that the bracket 48 would abut the telescoping shaft 38. Preferably, the links 44 and the openings 45 in them therefore are sized such that they will allow the blade to retract entirely from the ground even when at its greatest depth.

Although the linkage allows the blade to pull out of the ground, the amount of force required for it to do so can be quite high. The arbor pivot frame 30, arbor and other items mounted to the arbor pivot frame 32 can easily mass 30–50 kg. Therefore, a spring preferably is provided to counterbalance some of this weight. Specifically, a bracket 50 is mounted to the arbor pivot frame 30 and a spring 52 extends between the bracket 50 and a portion of the main frame 10. Preferably, a plurality of holes 51 are provided in the spring bracket 50 to enable adjustment of the degree to which the spring 52 is extended, thereby adjusting the amount of force necessary to raise the arbor 32 out of the ground.

Returning to FIGS. 2 and 3, side plates 54 are mounted on both arms 31 of the arbor pivot frame 30, immediately adjacent to the arbor 32 (for clarity of illustration, only the background plate 54 is shown in FIG. 3). As best seen in FIG. 2, the housing 20 has slots 56 in either side thereof to allow the shaft 34 to move up and down for varying depths of trench. The side plates 54 prevent dirt or other debris from being pushed out through these slots.

Similarly, trash guards 58 preferably are mounted to the underside of the arms 31 of the arbor pivot frame 30 to prevent dirt or other debris from being forced outward underneath the arbor pivot frame 30. Preferably, the trash guards 58 are formed of a heavy duty fabric, since a metal plate might catch on the ground.

The actual cutting teeth on the arbor 32 have been have been omitted from FIGS. 2 and 4 for clarity of illustration. The arbor 32 normally has a plurality of teeth spaced around its perimeter, as will now be described with reference to FIGS. 5*a*–5*f*. A variety of chucks 60 are shown. Each chuck 60 can have any of a number of mounting brackets 62 mounted to them, and the actual teeth 64 are held in the mounting brackets. Different combinations of chucks 60 and mounting brackets 62 then are mounted around the circumference of the arbor 32 to provide different widths for the trench. Preferably, mounting brackets 62 are selected such that each tooth 64 cuts a different part of the trench, and so that all parts of the trench are actively cut.

In use, the engine 27 rotates the arbor 32 in a direction such that the bottom of the arbor 32 is going toward the front of the trencher, and the teeth 64 mounted to the arbor 32 therefore are oriented to face forward as they move along the bottom of the arbor 32. This will cause the teeth 64 to help pull the arbor 32 down into the dirt to the maximum depth allowed by the telescoping shaft 38, until it reaches the stop brackets 65 on the main frame 11. The stop brackets 65 are positioned to prevent the pulley 26 from touching the ground.

Since there is dirt in front of the trench as it is dug, there is nowhere for the dirt being removed to go but up. The dirt therefore is carried up through the housing 20 to the deflector 22, where it is forced to one side or the other, depending on the orientation of the deflector 22. The discharge chute 24 of the deflector 22 is long enough to project the dirt past the rear wheels 12, spacing the dirt away from the trench by roughly the width of the trench. The depth of the trench can be controlled by adjusting the height of the telescoping shaft 38, while the width of the trench can be controlled by changing the combination of chucks 60 and mounting brackets 62 used.

Preferably, the wheels are spaced apart by about twice the width of the trench. This makes it possible to make two passes to make a double wide trench without a wheel falling into the trench. While a conventional trencher could make two passes, the resulting trench would not be clean. Due to the placement of the dirt spaced from the trench according to the present invention, even a double-pass trench will be clean. Adding shaft extensions to the rear wheels would even allow triple or more trenching passes.

Various modifications to the invention as described will be readily apparent to one of skill in the art. For example, various alternative linkages could be provided instead of the simple link with bolts shown. The present invention therefore is limited only by the claims.

I claim:

1. A trencher comprising:

a) a main frame;

b) an arbor support frame pivotally mounted to the main frame;

c) an arbor rotatably mounted to the arbor support frame;

d) an adjustable depth control mechanism having a fixed portion and an adjustable portion, the fixed portion being mounted to the main frame; and e) a linkage connecting the adjustable portion of the depth control mechanism to the arbor support frame, the weight of the arbor and arbor support frame normally pulling the linkage to an extended position, but the linkage allowing the arbor and arbor support frame to move upwards relative to the main frame in the event a force acts on the arbor in the upwards direction.

2. The trencher of claim 1, wherein the adjustable depth control mechanism comprises a telescoping shaft.

3. The trencher of claim 1, wherein the linkage comprises a bolt on the adjustable portion of the depth control mechanism, a bolt mounted to the arbor support frame, and a link having a long slot formed therein, the bolts extending through the long slot.

4. The trencher of claim 1, wherein a spring is provided stretched between the arbor support frame and a portion of the main frame above the arbor support frame, thereby to counterbalance at least some of the weight of the arbor and arbor support frame.

5. The trencher of claim 4, wherein the spring is connected to the arbor support frame via a bracket having a plurality of holes, such that the degree to which the spring is pre-stretched can be adjusted by attaching the spring to different ones of the holes.

6. The trencher of claim 1, further comprising:

a) two rear wheels, each rotatably and co-axially mounted to the main frame, and wherein the arbor is spaced equidistant from the rear wheels along their shared axis; and b) a front wheel mounted to a front wheel bracket, which is pivotally mounted to the main frame in front of and substantially in line with the arbor.

7. The trencher of claim 6, further comprising a steering handle mounted to the front wheel bracket to allow steering of the front wheel.

8. The trencher of claim 6, wherein the spacing between the two rear wheels is at least twice the maximum width of the trench, thereby allowing a double pass trench to be dug.

9. The trencher of claim 1, wherein a plurality of chucks with mounting brackets and teeth are mounted to the arbor.

10. The trencher of claim 9, wherein a plurality of sets of chucks with mounting brackets and teeth are provided, each set having a different width such that mounting of different sets of chucks will set the trencher to dig a different width trench.

11. The trencher of claim 9, wherein the mounting brackets can be remounted to the chucks in different orientations, such that mounting in different orientations will set the trencher to dig a different width trench.

12. The trencher of claim 1, further comprising:

a) an arbor housing mounted to the main frame substantially enclosing all four sides around the arbor, but with an open bottom to allow the arbor to engage the ground and an open top, so that in operation dirt dug up by the arbor will be forced upward in the arbor housing;

b) a deflector housing mounted to the top of the arbor housing to deflect dirt coming upward from the arbor housing to the side, the deflector housing having a discharge chute which extends to the side by a sufficient amount to discharge the dirt to the side of the trench by a distant at least about the width of the trench.

13. The trencher of claim 12, wherein the deflector housing is removably mounted to the arbor housing and is reversible to allow dirt to be discharged on either side of the trencher.

14. A trencher comprising:

a) a main frame;

b) an arbor support frame pivotally mounted to the main frame;

c) an arbor rotatably mounted to the arbor support frame;

d) a telescoping shaft having a fixed portion mounted to the main frame and an adjustable portion;

e) a link having a slot formed therein;

f) a first bolt mounted proximate to the end of the adjustable portion of the telescoping shaft and slidably extending through the slot in the link;

g) a second bolt mounted to the arbor support frame and slidably extending through the slot in the link, the weight of the arbor and arbor support frame normally pulling the link downward so that the first bolt abuts against the upper end of the slot and the second bolt abuts against the lower end of the slot.

15. The trencher of claim 14, further comprising:

a) a bracket mounted to the arbor support frame; and b) a spring extending between the arbor support frame and a portion of the main frame above the arbor support frame, thereby to counterbalance at least some of the weight of the arbor and arbor support frame.

16. The trencher of claim 14, further comprising:

a) an arbor housing mounted to the main frame substantially enclosing all four sides around the arbor, but with an open bottom to allow the arbor to engage the ground and an open top, so that in operation dirt dug up by the arbor will be forced upward in the arbor housing;

b) a deflector housing mounted to the top of the arbor housing to deflect dirt coming upward from the arbor housing to the side, the deflector housing having a discharge chute which extends to the side by a sufficient amount to discharge the dirt to the side of the trench by a distance of at least about the width of the trench.

17. The trencher of claim 16, wherein the deflector housing is removably mounted to the arbor housing and is reversible to allow dirt to be discharged on either side of the trencher.

* * * * *